US005232504A

United States Patent [19]

Didier et al.

[11] Patent Number: 5,232,504

[45] Date of Patent: Aug. 3, 1993

[54] MODULAR AND ADJUSTABLE GLUE DISPENSER

[75] Inventors: Carl J. Didier; Mark A. Walker, both of Piqua; John S. Whittenberger, Sidney, all of Ohio

[73] Assignee: Baumfolder Corporation, Sidney, Ohio

[21] Appl. No.: 754,497

[22] Filed: Sep. 3, 1991

[51] Int. Cl.[5] ..... B05C 5/02

[52] U.S. Cl. ..... 118/681; 118/703; 118/315; 118/323; 156/364; 156/442.1

[58] Field of Search ..... 118/680, 681, 696, 703, 118/712, 315, 323, 221, 241; 156/364, 442.1

[56] References Cited

U.S. PATENT DOCUMENTS

| | | | |
|---|---|---|---|
| 2,825,190 | 3/1958 | Heald . | |
| 3,088,433 | 5/1963 | Walter et al. | 118/681 |
| 3,138,514 | 6/1964 | Florio | 118/315 |
| 3,425,393 | 2/1969 | Shuh et al. | 118/681 |
| 3,955,528 | 5/1976 | Bounds et al. | 118/681 |
| 4,087,303 | 5/1978 | Strzalka . | |
| 4,111,153 | 9/1978 | Rohrbach . | |
| 4,244,319 | 1/1981 | Carstedt . | |
| 4,865,578 | 9/1989 | Moll . | |
| 5,048,809 | 9/1991 | Tebbe et al. | 118/681 |

FOREIGN PATENT DOCUMENTS

| | | | |
|---|---|---|---|
| 41033 | 12/1981 | European Pat. Off. | 118/681 |
| 1004355 | 3/1952 | France | 118/680 |

*Primary Examiner*—W. Gary Jones
*Assistant Examiner*—Todd J. Burns
*Attorney, Agent, or Firm*—Millen, White, Zelano & Branigan

[57] ABSTRACT

Pressure responsive glue dispensing nozzles are mounted on a pivotable glue distributing manifold. Rocker arms are attached to the glue distributing manifold and are actuated to pivot about a fixed pivot axis by solenoids. Adjustable stop means are used to limit and adjust the pivot stroke of the manifold so that the glue dispensing nozzles can dispense glue to one edge of a document that may have a varying thickness. Return means are provided to return the rocker arm assembly to a base position when the solenoids are de-energized.

12 Claims, 3 Drawing Sheets

MODULAR AND ADJUSTABLE GLUE DISPENSER

FIELD OF THE INVENTION

This invention relates to glue dispensing apparatus commonly associated with document folding apparatus in which documents, after having been folded a number of successive times, have glue applied at least once to one of their edges prior to passing through a subsequent roller to thus seal the document, thereby making the document suitable for mailing. More particularly, the invention relates to an especially compact, adjustable, and modular glue dispensing apparatus suitable for use in cramped space within document folding apparatus.

BACKGROUND AND OBJECTS OF THE INVENTION

In co-pending application, Ser. No. 07/343,447, filed on Apr. 26, 1989, now U.S. Pat. No. 5,048,809,—the contents of which are expressly incorporated herein by this reference—and assigned to the same assignee as the instant application, there is described document folding apparatus utilizing glue dispensing means. In general, the apparatus described in the co-pending application is characterized by a plurality of fold plates radiating, as spokes from a central part—the hub—where a plurality of rollers are clustered to sequentially feed documents to a succession of fold plates at which successive folds are imposed on the document. Glue dispensing apparatus is disposed on at least one of the fold plates to apply glue to one of the edges of the folded document so that when a subsequent fold is accomplished, the document gets folded onto a glued edge and thereby sealed.

When a plurality of folds is imposed on a document along one of its dimensions, it is apparent that the document will "shrink" with each successive fold. Thus, as the document is successively conveyed from the hub to a fold plate, back again to the hub, and subsequently to another fold plate, the distance that the document will travel along each successive fold plate will likewise "shrink" in a fashion analagous to that of an Archimedes Spiral. That is, the radial distance from the hub at which each subsequent folding operation occurs, decreases. The effect of this shrinkage is a tendency to concentrate successive stages of folding apparatus closer to the hub where the space availability for the apparatus becomes increasingly limited. In particular, where gluing apparatus is preferably used only in the last stage of folding apparatus, the space available for such gluing apparatus has become quite limited, especially where a plurality of folds have been imposed on a document.

Accordingly, it is a primary object of this invention to provide a glue dispensing apparatus having a physical profile adapted to the limited space availability in the latter stages of document folding apparatus having a plurality of fold plates.

As described in the aforementioned copending application, the glue dispensing apparatus disclosed therein preferably comprises, in one embodiment thereof, a glue distributing manifold to which are attached a plurality of pressure responsive glue dispensing nozzles. Solenoids mounted on top of the manifold move the manifold into engagement with a folded document to deposit a plurality of spots of glue onto one of the edges of a document. Apparatus featuring top mounted solenoids has been on sale by the assignee of this application for more than one year preceeding the filing date of this application and this feature thereby constitutes prior art against this application.

Solenoids mounted on top of a glue distributing manifold increase the profile of glue dispensing apparatus and limit the placement thereof to only those spaces capable of accomodating such profile.

Accordingly, it is another object of this invention to provide a solenoid actuated glue dispensing apparatus in which the solenoids are not mounted on top of the glue distributing manifold. The profile of such apparatus is thus decreased and thus allows placement of the apparatus in more restricted space environments.

The inherent characteristics of glues causes them to harden when exposed to air. Despite the use of pressure responsive nozzles which dispense glue only upon contact—thus sealing the glue in the nozzles from contact with air at all other times—it is inevitable that the nozzles will accumulate hardened glue deposits over a period of time of successive actuations. At such times the nozzles have to be cleaned.

Accordingly, it is yet another object of the invention to provide a manifold and nozzle assembly that can be easily detached from the glue dispensing apparatus so that the nozzles can be cleaned and freed from hardened glue deposits.

In addition to dealing with the above noted "shrinkage" of documents as they undergo successive folding operations, document folding and gluing apparatus also has to accomodate varying initial sizes of documents. Both of these demands require that any glue dispensing apparatus be adjustable.

Accordingly, it is a still further object of this invention to provide glue dispensing apparatus that can easily be adjusted to accomodate a variety of document sizes, whether in their initial stage, or any subsequent stage of the folding operation.

It is also clear that the thickness of a folded document will vary as the number of folds thereof varies. Any glue dispensing apparatus therefore which moves an assembly of pressure responsive glue dispensing nozzles into engagement with such folded documents has to be able to acccomodate such varying thickness.

It is therefore yet another object of the invention to provide glue dispensing apparatus which can easily be adjusted to accomodate a document of varying thickness.

Once adjustments, including the aforementioned ones, have been made to any document folding and gluing apparatus, the physical distances are normally fixed. However, a major adjustment remains, namely cycle speed. That is, the folding and gluing apparatus can be set to operate at cycle speeds which can, in the extreme, range from about one hundred documents per hour to ten thousand per hour. Thus, while the physical distances will not change during any given run of identical parameters, the time consumed in traversing those distances surely will.

Thus, it is still another object of the invention to provide gluing apparatus which can be adjusted to actuate glue dispensing nozzles at varying times within the variable cycle speed of the folding and gluing apparatus.

SUMMARY OF THE INVENTION

According to the invention, a glue dispensing assembly is mounted on a baseplate which can be moved along, and fixed at, various locations of a fold plate. Mounted on the base plate is a solenoid assembly that does not project above the base plate beyond the distance at which a glue distributing manifold is disposed above the baseplate. The glue manifold, to which is attached a plurality of pressure responsive nozzles, is itself attached to one end of a removable rocker arm assembly pivoted about an axis which is parallel to the longitudinal axis of the glue manifold.

The solenoid assembly, when energized, is adapted to pivot the rocker arm assembly—and hence the glue distributing manifold attached thereto—about the pivot axis to thus allow the plurality of pressure responsive nozzles to engage a folded document at one edge thereof and deposit a plurality of glue spots on that edge.

Simple pivot stroke adjustment stop means are fixed to the base plate to adjustably limit the amount of rotation of the pivoted rocker arm assembly while means are also provided to return the rocker arm assembly to a resting, base, position once the solenoid assembly is de-energized.

Removability of the rocker arm assembly together with the glue distributing manifold attached thereto is facilitated by connecting the rocker arm assembly with the stop means through a one-way open slot thereby allowing the rocker arm assembly to be laterally moved out of engagement with the stop means.

Photosensor means are disposed adjacent to the pressure responsive nozzles to sense the approach of a document, one edge of which has to be engaged by the nozzles for deposit of glue spots thereon. The photosensor means provide a timing signal that is supplied to adjustable downstream electronic apparatus which provides energizing signals to the solenoid assembly. The energizing signals to the solenoid assembly can be adjusted to occur with a variable delay after the photosensor means have provided the timing signal heralding the arrival of a document to which glue has to be applied.

The foregoing and other objects, features, and advantages of the invention will be apparent from the following more particular description of a preferred embodiment of the invention, as illustrated in the accompanying drawings in which like parts are numbered alike. The drawings are partly schematic, partly partial, not to scale, and are designed to illustrate the principles and functions of the various components of the invention, and include grossly exaggerated clearances for a clearer understanding.

DETAILED DESCRIPTION

Figure 1:
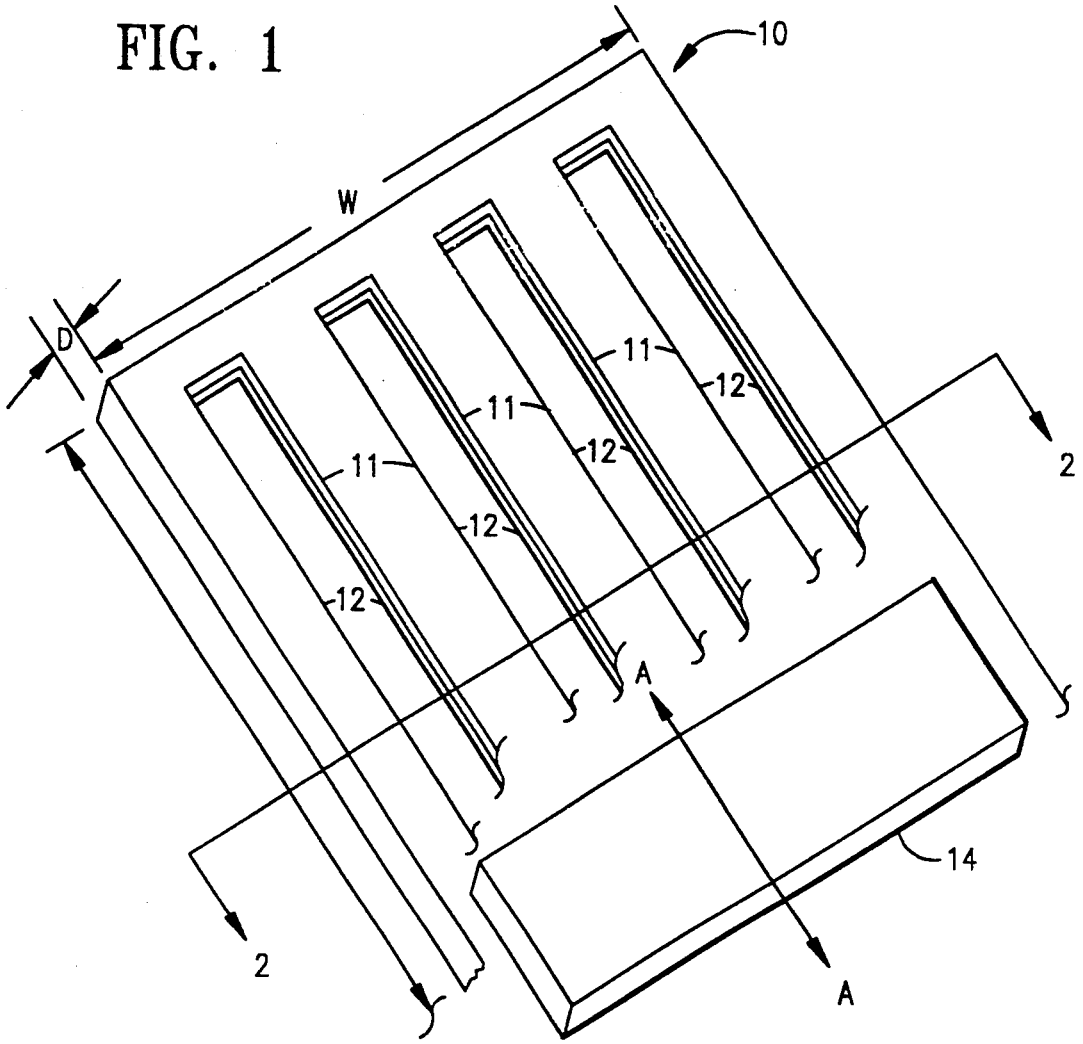
FIG. 1 shows a partial perspective view of a typical fold plate in a document folding apparatus together with a schematic represenation of the glue dispensing assembly of the invention cooperating therewith.

With reference to FIG. 1, there is shown a typical fold plate 10 of a representative document folding apparatus. As indicated in the aforementioned co-pending application referenced herein, a document folding apparatus generally contains a plurality of these fold plates, generally arranged as projecting radially from a central hub which contains a cluster of drive rollers, not shown here.

Fold plate 10 is characterized by a plurality of ridges 11 interspersed with a plurality of grooves 12 along the width W of fold plate 10. Glue dispensing assembly 14, indicated schematically and to be described in greater detail below, is adapted to be moved along fold plate 10, in the direction of arrow A—A. Glue dispensing assembly ( hereinafter "GDA" for the sake of simplicity) 14 can be moved into, and fixed at, any location along the length L of fold plate 10, by the mechanism shown in greater detail in FIG. 2.

Figure 2:
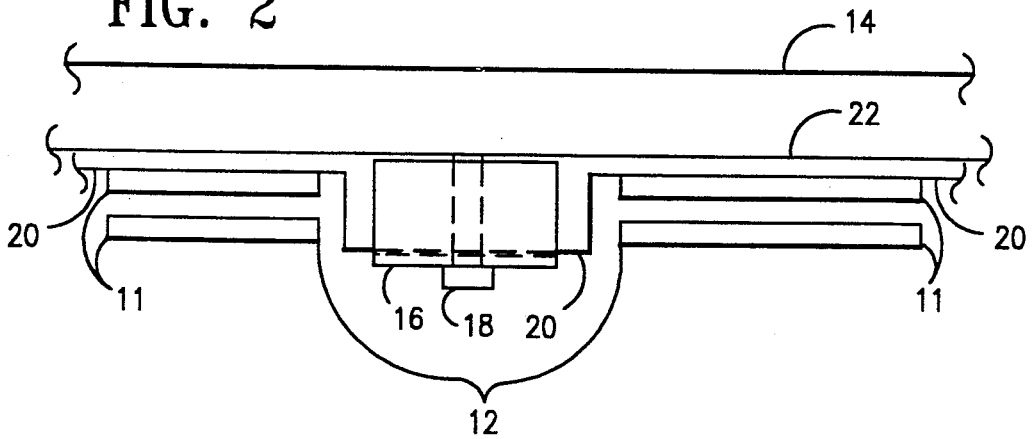
FIG. 2 shows a cross-sectional schematic view along the line 2—2 of FIG. 1.

With reference to FIG. 2, GDA 14 has attached to the bottom thereof a bracket 16 through which projects a threaded bolt 18 having attached thereto a base plate 22. Bracket 16 is adapted to engage a paper stop 20, a typical part of a fold plate in document folding apparatus, of fold plate 10 when the threaded bolt 18 is rotated to accomplish this and thereby fix the location of GDA 14 along the width W of fold plate 10. Since GDA 14 is fixed on paper stop 20, movement in the L direction of fold plate 10 is acccomplished by moving the fold plate, a typical folding apparatus. In other words, GDA 14 is piggy-backed on the movable paper stop 20.

Figure 3A:
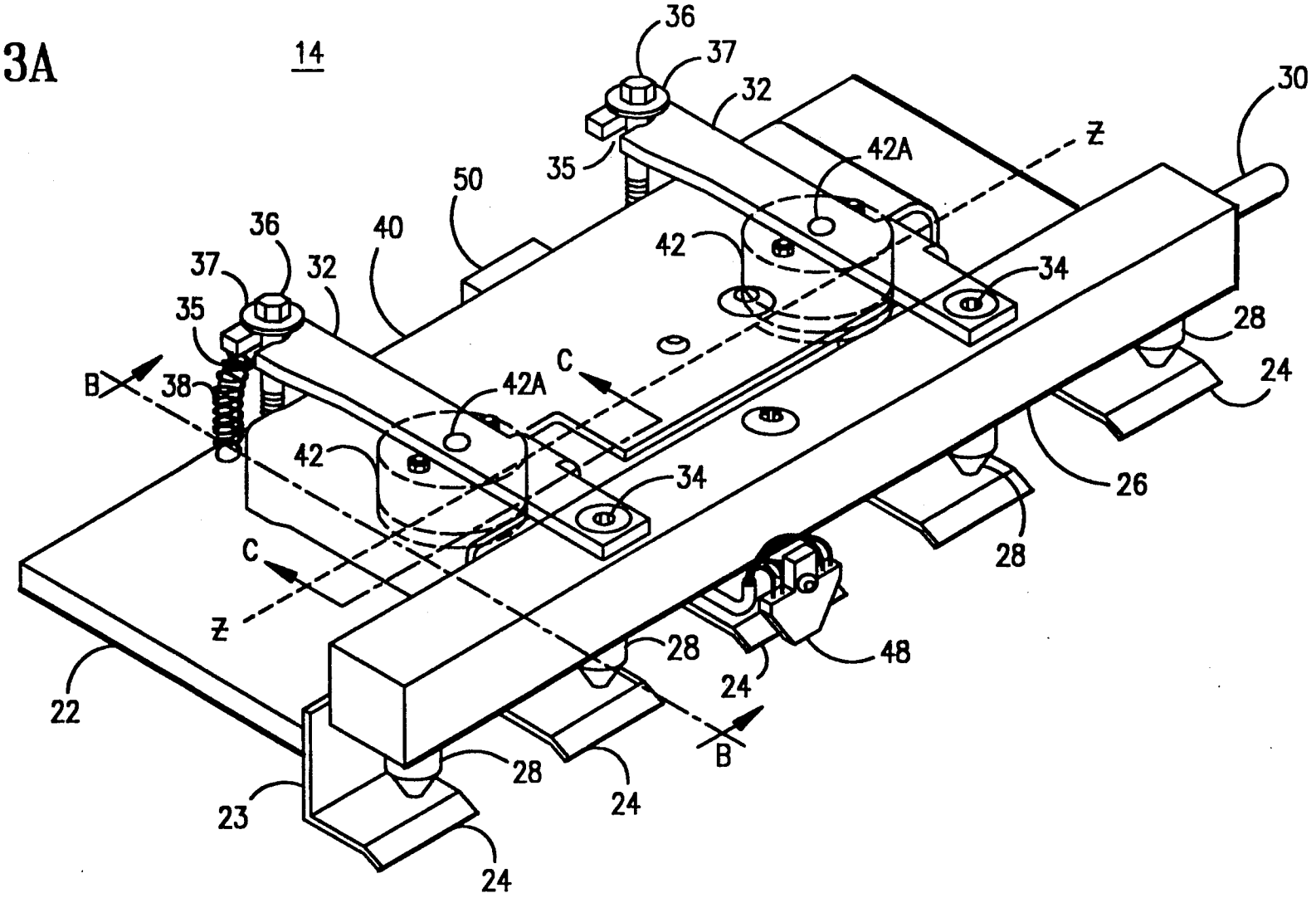
FIG. 3A is a perspective view of the glue dispensing assembly of the invention.

With reference now to FIG. 3A, there is shown a perspective view of the principal components comprising GDA 14.

A base plate 22 has at one edge thereof a depending edge 23 from which extend a plurality of rack bars 24 which are adapted to depend into, and enage with, the grooves 12 of fold plate 10. The depending edge 23 is perpendicular to the base plate 22 and functions as a paper stop for a document (not shown) that is to be glued. In this regard, as GDA 14 is preferably, but not necessarily, piggy-backed on an otherwise conventional, and adjustable paper stop 20, the depending edges 23 in effect replace functionally the normal stopping function of stop 20. A glue manifold 26, for distributing glue to a plurality of nozzles 28 attached to manifold 26, has a glue entry line 30 disposed at one end thereof. Glue manifold 26 has a length, and a longitudinal axis, sufficiently large to accomodate a sufficient plurality of nozzles for application of glue along a desired length of a document edge. It is noted that nozzles 28 are preferably of the pressure responsive type described in the aforementioned co-pending application to dispense glue only when in pressure contact with a surface to which glue is to be applied.

Figure 3B:
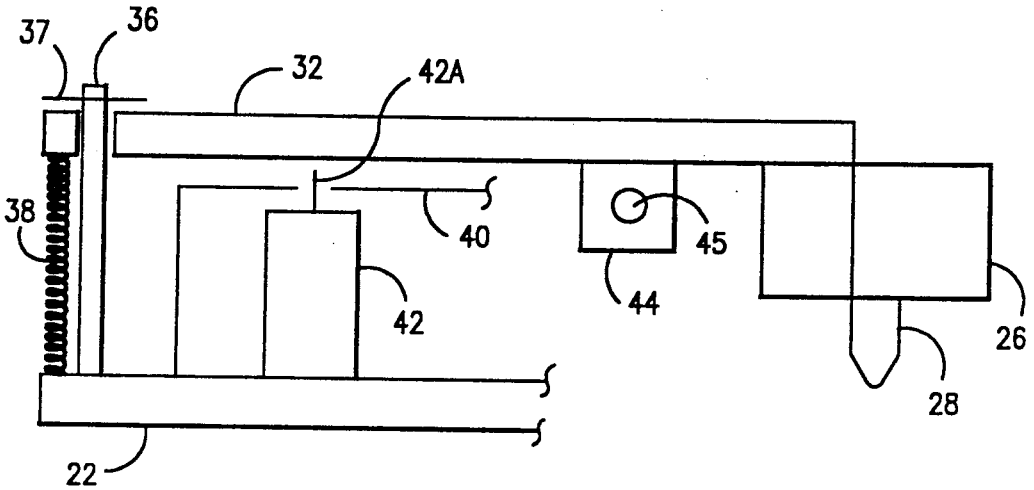
FIG. 3B is a cross sectional schematic view along line B—B of FIG. 3A.
Figure 3C:
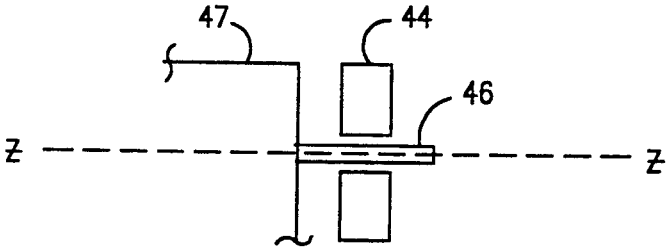
FIG. 3C is a cross sectional schematic view along line C—C of FIG. 3A.

A rocker arm assembly 32, preferably comprised of two separate rocker arms, is fixedly attached at one end thereof to glue manifold 26 by way of fasteners 34 to form a unitary structure. At the other end of rocker arm assembly 32 there are formed open slots 35, through which project a pair of threaded hex bolts 36. Washers 37 are preferably, but not necessarily, interposed between hex bolts 36 and rocker arms 32. Shown in FIG. 3A, and also shown in FIG. 3B, is a spring 38 fixed between base plate 22 and one of the rocker arms 32.

Also mounted on base plate 22 is a solenoid cover 40 which houses a solenoid assembly preferrably comprised of two identical solenoids 42. Solenoids 42 each have a solenoid pin 42*a* projecting through solenoid cover 40 and adapted to contact rocker arms 32 when solenoids 42 are energized.

Depending from rocker arms 32, between the opposite ends thereof, is a tab 44 having a circular hole 45 adapted to engage a pair of pivot pins 46 mounted on a pivot pin block 47 which, in turn, is fixedly mounted on base plate 22. Alternatively, pivot pins 46 may be mounted on the solenoid cover 40. Note that the tabs 44 are preferably an integral part of rocker arms 32 and are mounted on the rocker arms 32 asymetrically, that is, one is outboard, while the other is inboard.

A photosensor 48 is mounted on a post (not shown) affixed to the base plate 22 for sensing the approach of a document (not shown) into the gap between glue nozzles 28 and rack bars 24.

In operation, when solenoids 42 are energized, solenoid pins 42*a* will extend to contact rocker arms 32 causing them both to pivot about the pivot axis Z—Z established by the co-action of pivot pins 46 and holes 45 in tabs 44 attached to rocker arms 32. As a result of the pivoting motion of rocker arms 32, the glue manifold 26, fixed to the rocker arms 32 to form a unitary structure therewith, will likewise pivot and move glue nozzles toward the rack bars 24. When solenoids 42 are de-energized, i.e. current application to them ceases, spring 38, which has been placed in tension while the solenoids 42 were energized, exerts a restoring force to one of the rocker arms 32 to thereby return the unitary rocker assembly to a base, or resting, position.

Hex bolts 36, which may be turned in either direction, function as stop means limiting the movement of rocker arms 32 when moved by the solenoid pins 42*a*. Thus, when the hex bolts 36 are tightened, i.e. the distance between the tops of them and the base plate is decreased, movement of rocker arms 32 is restricted, and the pivoting motion of glue manifold 26 is likewise restricted so that a greater gap is created between nozzles 28 and rack bars 24 to accomodate a greater thickness of the document to be glued. Similarly, loosening of the hex bolts 36 will allow a greater motion of rocker arms 32, hence a smaller gap to be created between nozzles 28 and rack bars 24.

When cleaning of nozzles 28 becomes appropriate, the entire unitary assembly comprised of nozzles 28, glue manifold 26, and rocker arms 32 can be simply removed by detaching spring 38 and sliding the entire assembly along the axis Z—Z, in the open direction of slots 35 formed in the rocker arms 32.

Figure 4:
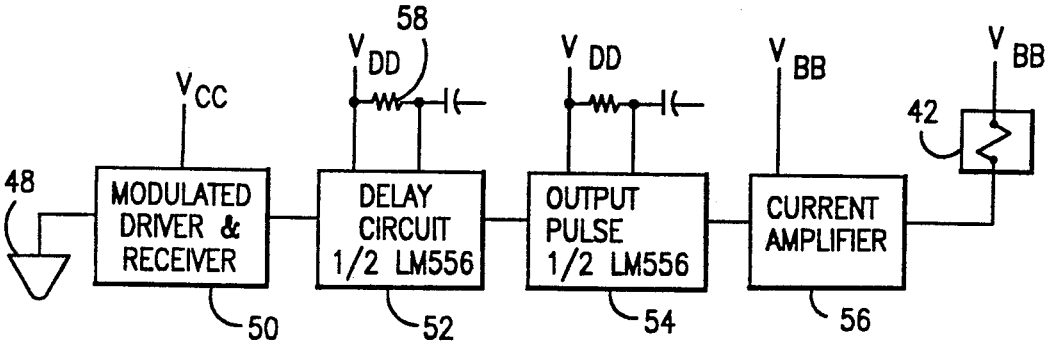
FIG. 4 shows a schematic of the electronic circuitry used in the invention.

With reference now to FIG. 4, there is shown the details of the electronic circuitry which allows the invention to accomodate various cycle speeds during which a variable number of documents are processed and glued.

As noted above, solenoids 42 have to be actuated whenever photosensor 48 detects the arrival of a document edge. Because the distance between photosensor 48 and edge 23 (which functions as a stop) is fixed, a variable speed of the approaching document edge (to thus indicate a varying cycle speed of the entire document folding apparatus) demands that the solenoid actuation signal be suitably varied. This is accomplished by circuitry which comprises a modulated driver and receiver circuit 50 responsive to a sensing signal from photosensor 48. The circuit 50 is preferably, but not necessarily, of an integrated circuit type, available from National Semiconductor Corp. under model number LM 567. Circuit 50, after amplification of the sensing signal from photosensor 48, provides the amplified signal to an adjustable delay circuit 52, comprised preferably of one half of another integrated circuit available from National Semiconductor Corp. under model number LM556.

The delay circuit 52 comprises an adjustable resistor 58, the adjustment of which allows the signal from circuit 50 to be delayed a suitable amount. When cycle speeds are low, a larger delay is indicated, while a smaller delay is called for when cycle speeds are high.

The other half of integrated circuit LM 556 functions as a pulse shaping circuit to create a square wave pulse which, after suitable amplification by current amplifier 56, is then applied to solenoid 42.

Various supply and biasing voltages are shown in FIG. 4 and these are provided by an alltogether conventional power supply circuit, the details of which are well known to those skilled in the art. Hence, such power supply is not shown.

MODIFICATIONS

The invention has been described with reference to a preferred embodiment which includes a rocker arm assembly comprised of two separate rocker arms actuated by a pair of solenoids. Clearly, the invention is not so limited.

For example, the dual rocker arms may be linked by an appropriate cross-bar, thus allowing a single solenoid, when that is desireable or feasible, to actuate the cross-bar and move the rocker arm assembly in unison to pivot the glue manifold attached thereto into engagement with the edge of the document to be glued.

Likewise, it may sometimes be desireable to replace the dual rocker arms, with their dual pivot points, with a single rocker arm, with a single pivot point, actuated by a single solenoid. In such case, a single hex bolt may serve as a suitable stop mechanism.

The return mechanism of the invention, to return the rocker arm assembly to its base, or resting, position when the solenoid assembly is de-energized, has been illustrated by the use of a spring mounted at one extremity of one of the rocker arms. Positioned at such extremity, the spring is placed in tension when the solenoid assembly is actuated and restores the rocker arm assembly to its base position when power is no longer applied to the solenoid assembly. Clearly, the spring may be mounted at any other position along the length of the rocker arm assembly to be able to exercise its return function.

While the invention has been particularly shown and described with reference to a preferred embodiment thereof, it will be understood by those skilled in the art that the foregoing and other changes in form and details may be made without departing from the spirit and scope of the invention as defined in the claims appended hereto.

What is claimed is:

1. Apparatus for applying glue to at least one edge of a folded document produced by a document folding machine, having at least one fold plate, comprising:

a base plate adjustably moveable along, and detachable from, said fold plate, said base plate having a plurality of racks depending therefrom and extending along the length of said fold plate;

a glue manifold having a longitudinal axis and having a plurality of glue applying nozzles attached thereto, said glue applying nozzles being aligned with said racks and separated therefrom by a gap;

rocker arm means attached to said glue manifold, said rocker arm means being pivoted about an axis that is i) parallel to the longitudinal axis of said glue manifold, and ii) fixed with respect to said base plate; and, solenoid means attached to said base plate for selectively actuating said rocker arm means to thereby pivot said rocker arm means and the glue manifold attached thereto so that said glue applying nozzles engage said at least one edge of said document when said document is inserted into the gap between said nozzles and said racks;

wherein said glue manifold is spaced from the said base plate for a first distance and wherein said solenoid means attached to said base plate do not project beyond said first distance.

2. Apparatus according to claim 1 further including adjustable stop means fastened to said base plate and engaging said rocker arm means for adjustably limiting the movement of said rocker arm means when actuated by said solenoid means.

3. Apparatus according to claim 1 further including means for returning said rocker arm means to a base position when said solenoid means are not actuated.

4. Apparatus according to claim 1 wherein said rocker arm means includes two rocker arms spaced along said axis.

5. Apparatus according to claim 1 wherein said solenoid means includes two solenoids spaced along said axis.

6. Apparatus according to claim 1 further including a stop edge that is perpendicular to said base plate and to which are fastened said racks and wherein said glue nozzles are spaced a fixed distance from said stop edge.

7. Apparatus according to claim 6 further including photosensor means for sensing the insertion of said edge of said document into the gap between said nozzles and said rack bars and for generating a signal in response to such insertion.

8. Apparatus according to claim 7 further including means responsive to said sensing signal for generating an actuating signal to actuate said solenoid means.

9. Apparatus according to claim 8 further including means for varying the time interval between said sensing signal and the generation of said actuating signal.

10. Apparatus according to claim 2 wherein said adjustable stop means engage said rocker arm means through an open slot in said rocker arm means.

11. Apparatus according to claim 10 wherein said rocker arm means together with said glue manifold attached thereto can be moved along said axis and said open slot to become disengaged from said stop means and said base plate.

12. Apparatus for applying glue to at least one edge of a folded document produced by a document folding machine, having at least one fold plate, comprising:

a base plate adjustably moveable along, and detachable from, said fold plate, said base plate having a plurality of racks depending therefrom and extending along the length of said fold plate;

a glue manifold having a longitudinal axis and having a plurality of glue applying nozzles attached thereto, said glue applying nozzles being aligned with said racks and separated therefrom by a gap;

rocker arm means attached to said glue manifold, said rocker arm means being pivoted about an axis that is i) parallel to the longitudinal axis of said glue manifold, and ii) fixed with respect to said base plate;

solenoid means located below said rocker arm and attached to said base plate for selectively actuating said rocker arm means to thereby pivot said rocker arm means and the glue manifold attached thereto so that said glue applying nozzles engage said at least one edge of said document when said document is inserted into the gap between said nozzles and said racks; and, adjustable stop means fastened to said base plate and engaging said rocker arm means for adjustably limiting the movement of said rocker arm means when actuated by said solenoid means;

wherein said adjustable step means engage said rocker arm means through an open slot in said rocker arm means; and, wherein said rocker arm means together with said glue manifold attached thereto can be moved along said axis and said open slot to become disengaged from said stop means and said base plate.

* * * * *